US005655346A

United States Patent [19]

Holmes et al.

[11] Patent Number: 5,655,346

[45] Date of Patent: Aug. 12, 1997

[54] STRUCTURAL MOUNTING SYSTEM

[76] Inventors: Eric Holmes, 4 Toorak Avenue, Baxter, Victoria 3911; Ian Howe, 19 Ryan Road, Pakenham, Victoria 3810, both of Australia

[21] Appl. No.: 403,681

[22] PCT Filed: Mar. 11, 1994

[86] PCT No.: PCT/AU94/00118

§ 371 Date: Mar. 13, 1995

§ 102(e) Date: Mar. 13, 1995

[87] PCT Pub. No.: WO94/20720

PCT Pub. Date: Sep. 15, 1994

[30] Foreign Application Priority Data

Mar. 12, 1993 [AU] Australia ..... PL7759

[51] Int. Cl.[6] ..... E04B 9/00

[52] U.S. Cl. ..... 52/476; 52/235; 52/461; 52/468; 52/474

[58] Field of Search ..... 52/726, 482, 476, 52/474, 461, 468, 235

[56] References Cited

U.S. PATENT DOCUMENTS

| | | | |
|---|---|---|---|
| 3,574,985 | 4/1971 | Pierce | 52/468 X |
| 4,736,563 | 4/1988 | Bilhorn | 52/474 X |
| 5,155,952 | 10/1992 | Herwegh et al. | 52/468 X |

FOREIGN PATENT DOCUMENTS

| | | |
|---|---|---|
| B23862/45 | 10/1945 | Australia . |
| B19425/76 | 5/1978 | Australia . |
| B50494/85 | 5/1987 | Australia . |
| A82723/87 | 5/1988 | Australia . |
| A52980/90 | 8/1990 | Australia . |
| A1163238 | 9/1958 | France . |
| A1163239 | 9/1958 | France . |
| A1169963 | 1/1959 | France . |
| A2277200 | 1/1976 | France . |
| A1683268 | 2/1971 | Germany . |
| A682091 | 7/1993 | Switzerland . |
| A796176 | 6/1958 | United Kingdom . |
| A2223043 | 3/1990 | United Kingdom . |
| A2226589 | 7/1990 | United Kingdom . |
| A0399778 | 11/1990 | United Kingdom . |
| WOA87/06291 | 10/1987 | WIPO . |
| WOA89/02016 | 3/1989 | WIPO . |

OTHER PUBLICATIONS

Jan. 26, 1993 Patent Abstracts of Japan, M1424, p. 44, JP,A, 5–18030 (Skin Nikkei Co Ltd).

*Primary Examiner*—Christopher Todd Kent
*Attorney, Agent, or Firm*—Gunn, Lee & Miller, P.C.

[57] ABSTRACT

A structural mounting system for mounting of structural components includes a base section and a co-operating section each of which in use is secured to a respective structural component and which are assembled together. The base section in cross section includes an undercut and the co-operating section in cross section includes a leg, having a toe projecting laterally to engage the undercut. When the sections are being coupled together the co-operating section is rotated about its longitudinal direction relative to its final position so that lateral movement of the toe to engage beneath the undercut requires the co-operating section to rotate about the longitudinal axis relative to the base section to adopt its final position. Spaced linear restraint points and a rotation restraint point together defining a triangle of points of contact to make the assembly of sections rigid. The sections have co-operating formations which require rotation of the co-operating section relative to the base section in a direction opposite to the direction of rotation to effect engagement of the toe with the undercut during close coupling of the two sections together until the toe reaches the undercut and the co-operating section can rotate to its final position.

19 Claims, 3 Drawing Sheets

Figure 1:
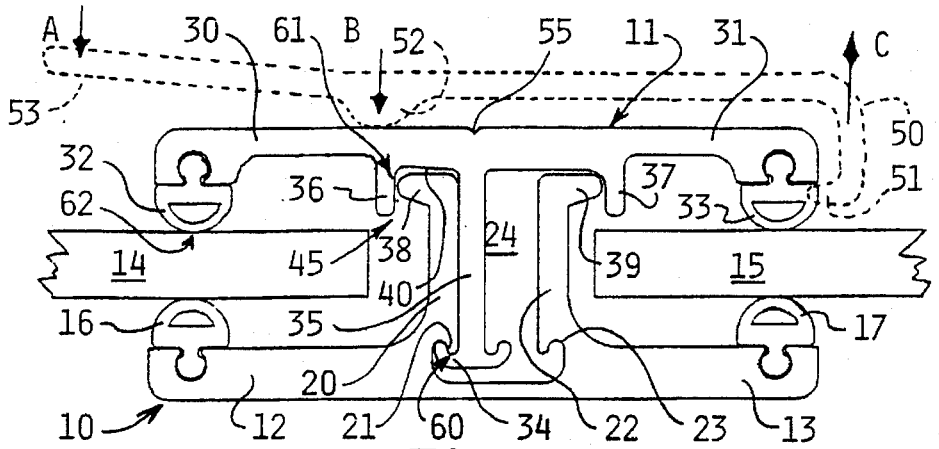

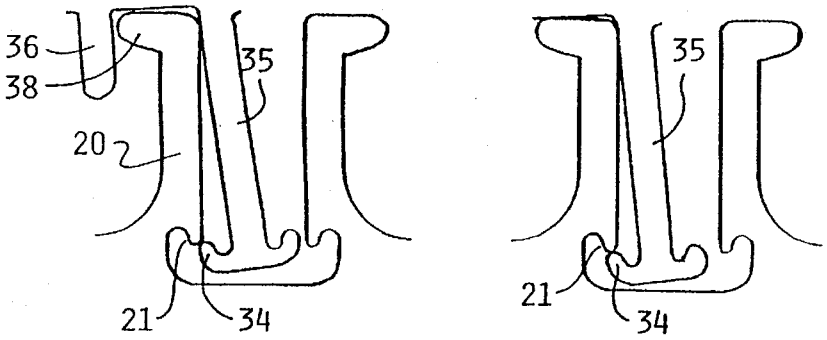
Fig.4
Fig.5
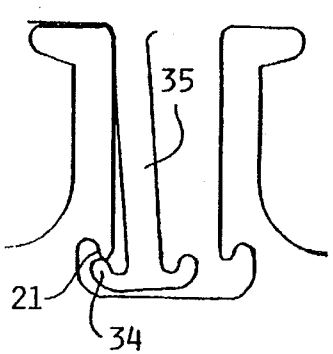
Fig.6
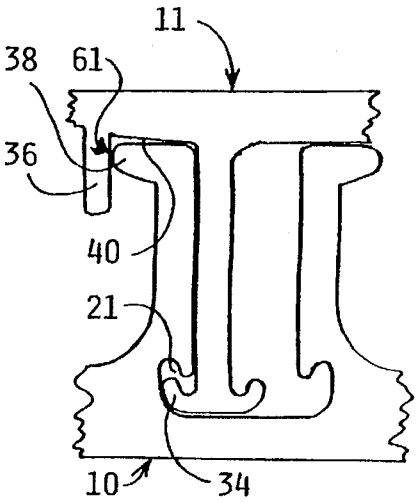
Fig.7

STRUCTURAL MOUNTING SYSTEM

This invention relates to systems for structural mounting of components, particularly for structural mounting of panel edges.

Some known panel edge mounting assemblies have complementary sections which snap fit together. In general, these assemblies suffer from one or more disadvantages including the non structural functions of one or both of the sections, the need for considerable force such as hammering to snap fit the sections together, the inability to curve the sections along their length so as to enable connection of the sections together in mounting of curved panel edges, and the inability to disassemble the sections without damaging or destroying one or both of the sections.

In patent specification No. AU-52980/90 there is described a panel edge mounting system having two mullion sections which snap fit together and which can be used to retain and mount the edge of a panel such as a glazing panel. The mullion sections in that specification can be formed into a curve along their lengths without warping or other distortion of the sections which might interfere with the snap fit of the sections together. However one of the mullion sections has relatively thin resilient webs which may be more susceptible to damage or distortion than a more robust configuration and also disassembly of the two mullion sections may be difficult without damaging one of the sections.

It is an object of the present invention to provide a structural mounting system suitable for mounting of or mounting to structural components, such as panel edges, which provides a useful alternative to mounting systems of the prior art.

It is a further object to provide a structural mounting system which enables assembly of the components in a novel manner.

It is a further and preferred object of the present invention to provide a structural mounting system suitable for a panel edge which can provide structural support at or structural support of a panel edge, and which preferably can be used for curved panel edges.

According to the present invention there is provided a structural mounting system for mounting of structural components together, the system including a base section and a co-operating section each of which in use is secured to a respective structural component and which are assembled together for mounting of the structural components together, the base section being elongated in a longitudinal direction and in cross-section including an undercut, the co-operating section also being elongated in the longitudinal direction and in cross-section including a leg which extends generally towards the base section, the leg having a toe projecting laterally from the leg and being arranged to fit beneath and to engage the undercut of the base section so as to couple the base section and co-operating sections together, the co-operating section adopting a final position relative to the base section when the base section and co-operating section are coupled together and the toe engages beneath the undercut, the base section and co-operating section being constructed and arranged so that when the base and co-operating sections are being coupled together the co-operating section is in a rotated position in which the co-operating section is rotated about the longitudinal direction relative to its final position, the co-operating section when being coupled to the base section requiring lateral movement of the toe to a position beneath the undercut and the co-operating section having rotated about the longitudinal axis relative to the base section to adopt its final position, the co-operating and base sections when assembled together defining at least two linear restraint points where the co-operating and base sections are in contact and where linear displacement between the sections is restrained by the contact, the linear restraint points including a first linear restraint point located at the point of contact of the toe and undercut where restraint against linear direct separating movement of the sections away from each other occurs, the linear restraint points including a second linear restraint point displaced from the first linear restraint point and where linear translation movement of the sections at fight angles to the longitudinal direction and at right angles to the line of direct separating movement is restrained, the sections when assembled and in use further having a rotation restraint point displaced from the linear restraint points and where rotation of the co-operating section relative to the base section in a direction to disengage the toe from the undercut is restrained, the first and second linear restraint points and the rotation restraint point together defining a triangle of points at which movement of the assembled sections is restrained.

The reference to one of the sections as a "base section" does not imply that that particular section is located beneath the other co-operating section or that the base section necessarily provides structural properties, but the name is a convenient designation for the component which in the preferred embodiment does lie beneath the co-operating section and does provide structural properties.

The toe may be turned up relative to the leg and the undercut may be turned down so that at the first linear restraint point, the contact between the toe and the undercut provides at least some restraint against relative linear translation movement between the assembled sections.

The co-operating and base sections may be provided with co-operating formations which enable the two sections to be initially separate with the leg extending substantially directly towards the base section, the co-operating formations enabling the two sections to be then moved directly linearly towards each other so that the co-operating formations guide the two sections into loosely coupled positions in which the toe does not reach and engage beneath the undercut, the co-operating formations being configured so as to require rotation of the co-operating section relative to the base section in a direction opposite to the direction of rotation to effect engagement of the toe with the undercut during close coupling of the two sections together until the toe reaches the undercut and the co-operating section can rotate to its final position. The co-operating formations may be comprised by guide means which cause rotation of the co-operating section relative to the base section during relative movement of the sections from their loosely coupled positions into close coupling.

There may be provided co-operating guide means provided by the co-operating and base sections and arranged to guide relative movement of the sections during their assembly together so that the toe is guided towards the undercut during assembly of the two sections together.

In a preferred embodiment of the system, the lateral movement of the toe into its position beneath the undercut may comprise a pivoting movement of the co-operating section relative to the base section, the pivoting movement occurring about a pivot displaced from the region of the toe and the undercut, so that the pivoting movement causes the co-operating section to rotate from its rotated position to adopt its final position relative to the base section.

In this preferred embodiment, there may be provided guide means provided by the co-operating and base sections, the guide means constraining the co-operating section to adopt its rotated position relative to its final position during movement of the co-operating section into engagement with the base section and before the toe reaches and engages beneath the undercut. The guide means may include a wall projecting from the base section towards the co-operating section, the wall having the undercut at its extremity remote from the co-operating section, whereby in assembling the co-operating section to the base section, the toe travels down the wall towards the undercut, the guide means further including a projection provided by the co-operating section and guide formation located at the top of the wall remote from the undercut, the projection and guide formation at the top of the wall being capable of engaging with each other upon the co-operating section being oriented in its rotated position, whereby the engagement of the toe against the wall as it travels down the wall before reaching the undercut and the co-operating engagement of the projection with the guide formation maintain the co-operating section in its rotated position until the toe reaches and moves back laterally into its position engaging beneath the undercut.

Alternatively, the guide means may include a wall projecting from the base section towards the co-operating section, the wall being located on the opposite side of the leg to the toe so that the leg is inserted into the space between the wall and the undercut, the guide means further including a fulcrum defined at point of contact between the wall and the leg and located so that the co-operating section needs adopt its rotated positions during initial insertion of the leg between the wall and the undercut and so that rotation of the co-operating section about the fulcrum causes the toe to engage beneath the undercut and then causes the co-operating section to adopt its final position. In this alternative embodiment, the guide means may further include a profiled surface provided by the base section and which is located above the undercut and facing the co-operating section, the profiled surface being engaged by the toe as the sections are being coupled together and being shaped so as to deflect the toe laterally thereby promoting rotation of the co-operating section to its rotated position until the toe passes the profiled surface and reaches the undercut.

At least one of the sections in the first embodiment may provide resilient resistance means operative, when the base section and co-operating section are being coupled together and the co-operating section is in its rotated position before the toe engages beneath the undercut, to resist the final stages of linear movement of the co-operating section relatively towards the base section immediately before the toe can move laterally into its position beneath the undercut. The co-operating section may include a side portion extending laterally therefrom relative to the leg and which engages with the respective structural component, the resistance means comprising the side portion which resiliently yields when the co-operating section is being urged into engagement with the base section with the co-operating section in its rotated position thereby enabling the toe to reach the undercut, and the resistance means also assisting the co-operating section to rotate to its final position and the toe to engage beneath the undercut as a result of resilient return movement of the side portion. Alternatively, or in addition, the resistance means may include a resiliently deformable sealing member which engages with the respective structural component when the co-operating section and base sections are being urged together with the co-operating section in its rotated position, the resilient deformation of the sealing member providing resistance to movement of the co-operating section to the position where the toe can engage beneath the undercut, whereby when the toe reaches and moves laterally to engage beneath the undercut, the resilient returning movement of the sealing member assists rotation of the co-operating section to its final position and assists movement of the toe into position beneath the undercut. The sealing member may remain resiliently deformed after the toe has moved into its position beneath the undercut, whereby the resilient deformation of the sealing member biases the co-operating and base sections in a direction to move them linearly apart thereby biasing the toe into engagement with the undercut.

The base section may include a mouth having the undercut provided at one side, thereof and a contoured opposite face at the opposite side of the mouth, the co-operating section having on the side thereof opposite to the toe a profiled heel section which co-operates with the contoured opposite face of the mouth during rotation of the co-operating section to maintain the toe in a position beneath the undercut, the contact between the profiled heel section and the contoured opposite face of the mouth constituting the second linear restraint point after the co-operating section has been rotated to its final position. In this embodiment, the base section may include a spacious access zone enabling the leg with the toe projecting therefrom to be located in the access zone with a loose tolerance and at a range of angular positions all of which are angularly displaced from the final position of the co-operating section, the access zone being shaped to guide the toe towards and into engagement with the undercut during rotation of the co-operating section towards its final position.

Both the base section and the co-operating section may be constructed so as to be capable of being initially formed, e.g. by extrusion, in straight lengths and afterwards rolled or otherwise curved along their lengths to enable mounting of curved panel edges for example. For enabling curving, the sections may be generally T-shaped in cross section with the cross piece of the T section constituting side portions which overlap respective adjacent panel edges and the stem of the T shape providing the means for coupling and guiding the sections together. The stem of the T shape in the case of the co-operating section may constitute the leg provided at its outer extremity with the toe. In the case of the base section, the stem of the T shape constitutes the wall forming part of the guide means and having the undercut at the base of the stem where it joins the cross piece.

Figure 2:
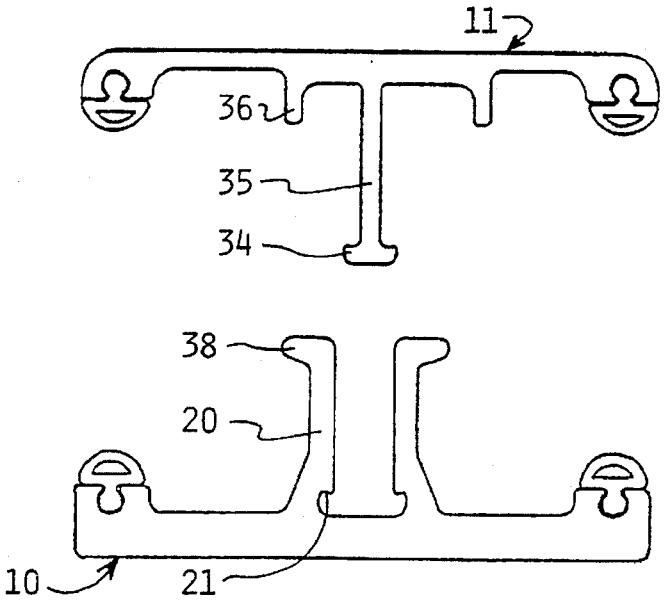
Figure 3:
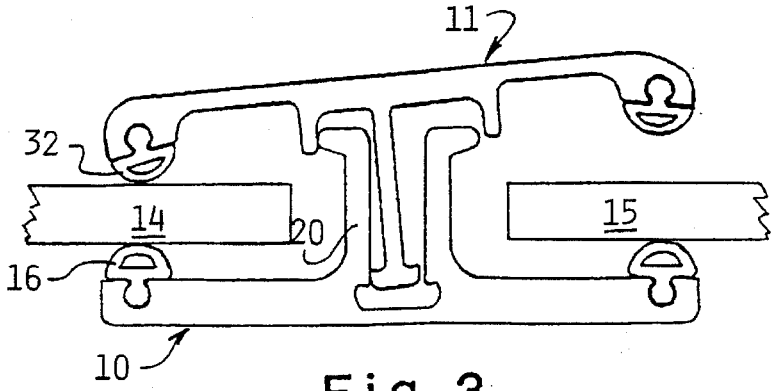
Figure 8:
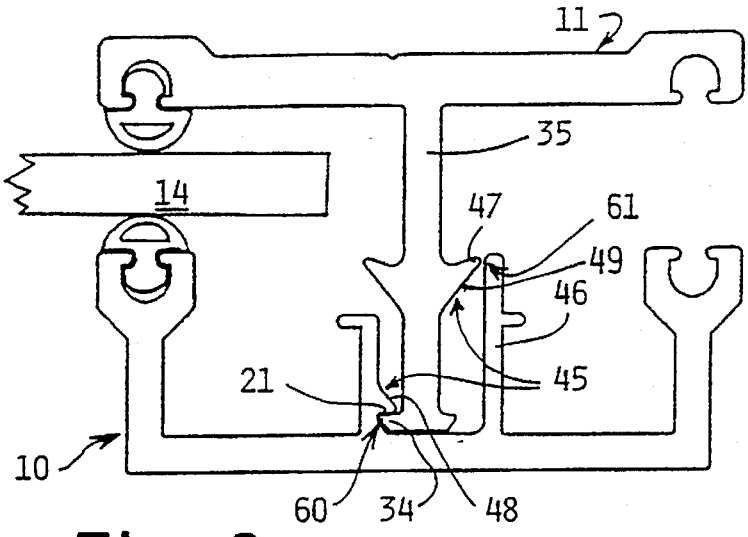
Figure 9:
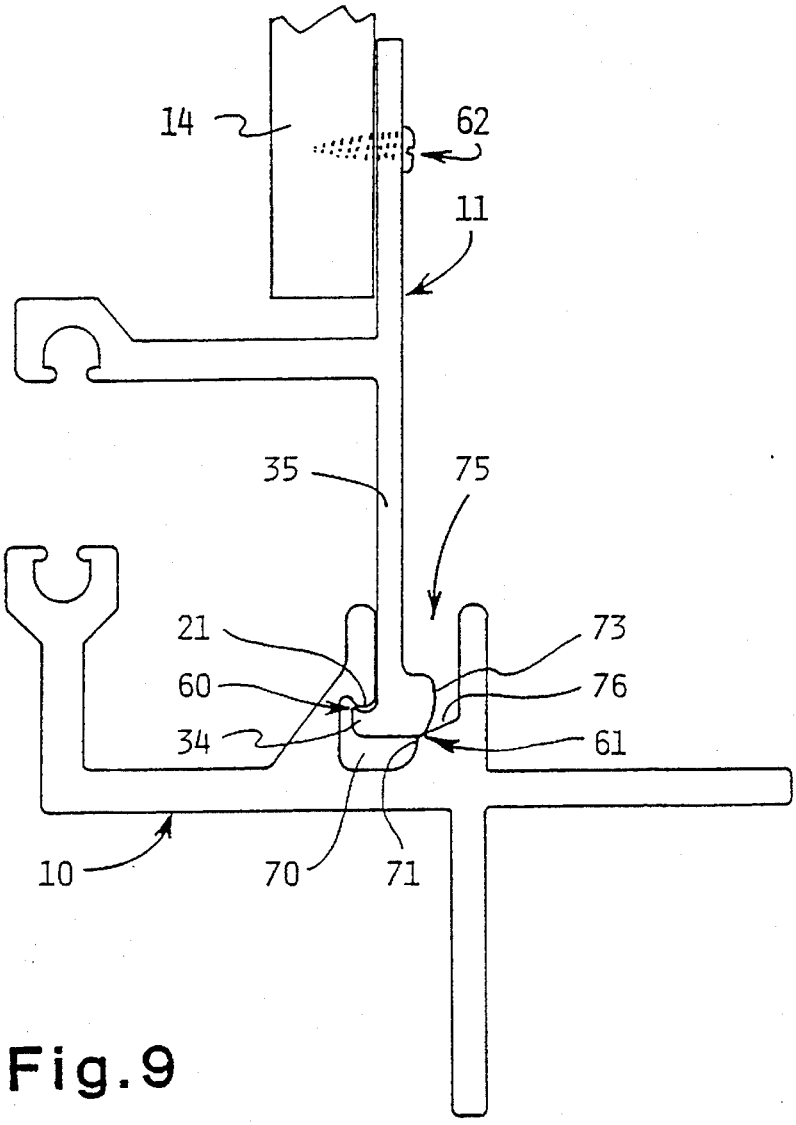

Possible and preferred features of the present invention will now be described with particular reference to the accompanying drawings. However it is to be understood that the features illustrated in and described with reference to the drawings are not to be construed as limiting on the scope of the invention. In the drawings:

FIG. 1 shows in cross section a first mounting system in use mounting two panel edges adjacent to each other, FIG. 2 shows the two sections of FIG. 1 disassembled and aligned before being coupled together, FIG. 3 shows the sections of FIG. 1 being coupled together with the co-operating section being caused to rotate prior to engagement of the toe beneath the undercut, FIGS. 4 to 7 show in detail the final sequential stages of movement of the sections of FIG. 1 in which the toe engages beneath the undercut, FIG. 8 shows in cross-section an alternative mounting system for use in mounting two panel edges adjacent to each other, and FIG. 9 shows in cross-section a further alternative mounting system suitable for mounting a panel edge attached to the co-operating section to a base section which can be secured to a component of a building structure.

Referring to FIGS. 1 to 7 of the drawings, the system includes a base section 10 and co-operating section 11 both in the form of aluminium extrusions or the like. The base section 10 is generally T-shaped having the cross piece defining two side portions or flanges 12, 13 which overlap the panel edges 14, 15. The side flanges 12, 13 have resilient sealing beads 16, 17 which seal against the panel edges.

The stem of the generally T-shaped base section 10 includes a wall 20 providing at its base an undercut 21. The wall 20 and undercut 21 are duplicated by symmetrically facing wall 22 and undercut 23 to enable the co-operating section 11 to be reversed and the toe to engage beneath undercut 23.

The co-operating section 11 is also generally T-shaped having side flanges 30, 31 having respective resilient sealing beads 32, 33 which are in use compressed and which seal against the panel edges 14, 15. The generally T-shaped co-operating section 11 has a leg 35 forming the stem of the T-shape and having a toe 34 projecting laterally at the end of the leg. The leg 35 is not symmetrically placed relative to the walls 20, 22 of the base section 10 since the leg is designed to move down one of the walls 20, 22 when being inserted into the space 24 between those walls and to lie against one of the walls when the toe 34 engages beneath the adjacent undercut 21, 23.

Guide means 45 comprise projections 36, 37 in the form of relatively short walls projecting downwardly from the side flanges 30, 31. These projections 36, 37 co-operate with offset guide formations 38, 39 at the upper ends of the walls 20, 22 and thereby guide the co-operating section 11 into its final position aligned with and facing the base section 10.

When the base and co-operating sections 10, 11 are being coupled together, as shown in FIG. 2, the two sections can be generally in registry and the cross pieces of the two T-shapes generally parallel. However, as the two sections 10, 11 are moved into engagement and the leg 35 enters the space 24 between the walls 20, 22, the guide projection 36 on the underside of the side flange 30 will encounter the guide formation 38 at the top end of the wall 20. In order to couple the sections together, the co-operating section 11 must be rotated or twisted to allow the projection 36 to pass the guide formation 38 and thus the sections 10, 11 adopt the relatively rotated relationship shown in FIG. 3. The leg 35 and walls 20, 22 are preferably relatively thick so that there is no significant lateral distortion or bending of the leg 35 or walls 20, 22, or projections 36, 37 which might allow the sections to be moved together without rotating to the position shown in FIG. 3.

As the sections are further forced together from the position shown in FIG. 3, the resilient sealing bead 32 (and/or, if desired, some resilient flexing of the side flange 30) enables the leg 35 to be further forced into the space 24 and, as shown in the sequence in FIGS. 4 to 7, the toe 34 can pass laterally into a position beneath the undercut 21. At the same time, the sections 10, 11 relatively rotate to their final relative configuration (FIG. 7). As shown in FIG. 1, the inside face 40 of the side flange 30 between the leg 34 and projection 36 is in cross section inclined to the wall 20 so as to assist the toe 34 to pass into its position beneath the undercut 21.

When the force urging the co-operating section 11 and base section 10 together is released, the resilient sealing beads 16, 17, 32, 33 (which will be all pressed against the panel edges 14, 15) will urge the base and co-operating sections 10, 11 apart to the position shown in FIG. 1 where the toe 34 closely fits with and is pressed against the undercut 21. However, this action of the sealing beads is not necessary to maintain the sections together, particularly in the case of curved sections, since the relative rotation or twisting necessary to disengage the sections is prevented by resistance of the sections to such twisting when they are coupled together unless force is applied to resiliently distort one or both of the sections or a part thereof.

When the sections 10, 11 are assembled together as shown in FIG. 1, there are linear restraint points where the sections 10, 11 are in contact and where linear displacement between the sections is restrained by the contact. A first linear restraint point 60 is located at the point of contact of the toe 34 and the undercut 21 where restraint against linear direct separating movement of the sections away from each other occurs. A second linear restraint point 61 displaced from the point 60 occurs where the projection 36 contacts formation 38 at the top of the wall 20. Contact at this point 61 restrains the sections 11, 12 against linear translation movement at fight angles to the longitudinal direction and at fight angles to the line of direct separating movement. Further linear restraint points can occur where leg 35 engages the top of the wall 20, and where projection 37 engages formation 39.

When the sections 10, 11 are assembled there is a rotation restraint point 62 displaced from the points 60 and 61 where rotation of the co-operating section 11 relative to the base section 10 in a direction to uncouple the toe 34 from the undercut 21 is restrained. The rotation restraint point 62 is defined where the sealing member 32 contacts the panel edge 14 where resilient deformation of the sealing member 32 is required in order to rotate the co-operating section 11 to its rotated position shown in FIG. 3. Other rotation restraint points where clockwise relative rotation of the section 11 is restrained occur at the engagement of side flange 31 with the top of the wall 22, and at the engagement of bead 33 with panel 15.

The linear restraint points 60, 61 and the rotation restraint point 62 define a triangle of points at which movement of the assembled sections 10, 11 is restrained so as to make the assembly rigid (although still being capable of disassembly).

It will be seen that in the illustrated embodiment, the toe 34 and undercut 21, 22 have complementary hook shaped profiles to resist disengagement without first forcing the sections together to the position shown in FIG. 7, followed by rotation of the co-operating section 11 to disengage the toe 34 and undercut 21 by passing through the sequence of positions shown in FIG. 7, FIG. 6, FIG. 5 and FIG. 4.

For use in disengaging the sections after being coupled together, a tool 50 can be used as schematically illustrated in broken line in FIG. 1. The tool 50 has a hook 51 to engage under one side flange 31, a fulcrum 52 to engage with the side flange 30 generally immediately above the projecting formation 36, and a handle 53 for the application of force. A force applied to the handle 53 in the direction of arrow A applies a downward force in the direction of arrow B at the fulcrum 52 and a lifting force in the direction of arrow C by means of the hook 51. The force at the fulcrum 52 forces the sections 10, 11 to the position shown in FIG. 7 and the force in the direction of arrow C applied by the. hook 51 applies a rotating force to disengage the toe 34 from the undercut 21. The tool can be progressively slid along an assembly, continually disengaging the sections as it is moved along.

Both the base section 10 and co-operating section 11 in FIGS. 1 to 7 are capable of being curved along their lengths. This is possible since all thicknesses of components in cross section can be sufficiently large to provide structural strength and resist any deformation during bending of the section along its length. Thus the invention can be useable for mounting of curved glazing panels in edge to edge relationship, e.g. for a barrel vault.

Since both sections 10, 11 are formed entirely of relatively thick structural strength sections, both sections can provide structural support for the assembly. During coupling of the sections together there is no deformation of the sections to any significant extent, the coupling being possible by the rotating interengagement of the sections.

In use for joining curved glazing panels in a barrel vault, the lower base section 10, in its curved form, can be anchored at each lower end so as to curve upward and over the vault. The base section will remain in a vertical plane whilst in any cross section the side flanges 12, 13 remain horizontal. The matching curved top cap co-operating section 11 can be inserted into the lower base section 10 by rotating out of horizontal and then returning the cross section back to the original horizontal plane, locking the two parts together. While the two sections are being placed in the curved form, and during progressive fitting together, the curved horizontal cross section plane prevents disengagement of the sections. The assembly cannot then come apart without a mechanical removal. A notch 55 in the top face of the co-operating section 11 above the leg 35 enables a self tapping screw to be inserted to deform the top of the leg 35 and thereby wedge the sections 10, 11 together for a permanent attachment. A screw or pin could also be inserted through section 10 into space 24 to engage and pass by the heel on the opposite side of the leg 35 to the toe 34, thereby permanently securing the sections 10, 11 together.

In FIG. 8, the same reference numerals as FIGS. 1 to 7 are used to indicate corresponding components and features. However in FIG. 8, the guide means 45 includes a wall 46 projecting from the base section 10 towards the co-operating section 11. The wall 46 is located on the opposite side of the leg 35 to the toe 34 so that the leg 35 is inserted into the space between the wall 46 and the undercut 21. There is a fulcrum 47 where the leg 35 contacts the wall 46. The fulcrum 47 is part of the leg 35 but could be provided by a projection at the top of the wall 46. The fulcrum 47 is located so that the section 11 needs to adopt a rotated position (similar to FIG. 3) during initial insertion of the leg 35 between the wall 46 and the undercut 21. Anticlockwise rotation of the section 11 about the fulcrum 47 enables the toe 34 to engage beneath the undercut 21 and causes the co-operating section 11 to adopt its final position shown in FIG. 8. The point of contact between the fulcrum 47 and the leg 35 defines the second linear restraint point 61.

Co-operating formations 48, 49 comprise the guide means 45 which cause rotation of the co-operating section 11 relative to the base section 10 during relative movement of the sections from their loosely coupled positions into dose coupling. That is, the two sections are initially separate with the leg 35 extending directly towards the base section 10. The two sections 10, 11 are then moved directly linearly towards each other so that the co-operating formations 48, 49 guide the two sections into loosely coupled positions in which the toe 34 does not reach and engage beneath the undercut 21. The co-operating formations are configured so as to require rotation of the co-operating section 11 relative to the base section 10 in an anticlockwise direction until the toe 34 reaches the undercut 21 and the co-operating section 11 can rotate to its final position as illustrated. The co-operating formations comprise a profiled surface 48 provided by the base section 10 and which is located above the undercut 21 and facing the co-operating section 11. The profiled surface 48 is engaged by the toe 34 as the sections 10, 11 are being coupled together and being shaped as a ramp so as to deflect the toe 34 laterally thereby promoting rotation of the co-operating section 11 to its rotated position until the toe 34 passes the profiled surface 48 and reaches the undercut 21. Ramp surface 49 on the leg: 35 below the fulcrum 47 contacts the top of the wall 46 if the section 11 is initially displaced to the right and as a result aligns the sections as desired for the toe 34 to engage the profiled surface 48.

In FIG. 9 the same reference numerals as FIGS. 1 to 8 are used to indicate the same constructional and functional features of the sections. FIG. 9 shows a co-operating section 11 assembled with a base section 10. The base section 10 may be secured to a component of a building structure and the section 11 may be secured to a panel 14 such as a glazing panel intended to span across a glazed vault.

In FIG. 9, the base section 10 includes a mouth 70 having the undercut 21 provided at one side and a contoured opposite face 71. The co-operating section 11 has on the side thereof opposite to the toe 34 a profiled heel section 72 which co-operates with the contoured face 71 of the mouth 70 during rotation of the section 11, the co-operation of the heel 72 with the contoured face 71 maintaining the toe 34 in a position beneath the undercut 21. Contact between the profiled heel section 72 and the contoured face 71 of the mouth 70 constitutes the second linear restraint point 61 after the section 11 has been rotated to its final position shown in FIG. 14.

The mouth 70 includes a spacious access zone 75 which enables the leg 35 with the toe 34 projecting therefrom to be located in the access zone 75 with a loose tolerance. The access zone 75 is shaped to guide the toe 34 towards the undercut 21. In order to couple the sections together the co-operating section must be located in a position rotated anticlockwise from the position in which the leg 35 extends directly towards the base section 11, enabling the toe 34 to fit under the undercut 21. Subsequently, the section 11 is rotated clockwise relative to the base section 10 to its final position and the toe 34 remains beneath the undercut 21 and in engagement therewith. The final position of the section 11 could be the one shown in FIG. 9 or the section 11 could be further rotated clockwise and fixed by means of the panel 14 in that position. The panel 14 could be for example a glazing panel of a barrel vault. The rotation restraint point 62 is constituted by the point of fixing of the section 11 to the panel 14 which itself is fixed in position at other displaced mounting points.

In all embodiments, the co-operating section 11 must be rotated, preferably between about 5° and 12° to the final position in FIGS. 1 to 8 and at similar or greater angles in FIG. 9, before the two sections can be fitted together and without deformation of the leg 35 or components of the base section 10. The toe 34 engages beneath the undercut in which position the section 11 is rotated back to its final position. A triangle of restraint points including the toe and undercut engagement point 60, at least one other linear restraint point 61 and a rotation restraint point 62 lock the sections 10, 11 in their final assembled positions although allowing disassembly if desired.

What is claimed is:

1. A structural mounting system for mounting of structural components together, said system comprising:

a base section and a co-operating section each of which in use is secured to a respective structural component and which are assembled together for mounting of said structural components together;

said base section being elongated in a longitudinal direction, said base section when viewed in cross-section transverse to said longitudinal direction comprising an undercut;

said co-operating section being elongated in said longitudinal direction, said co-operating section, when viewed in cross-section transverse to said longitudinal direction, further comprising a singular, rigid, leg projecting generally perpendicular to said longitudinal direction said leg having a toe projecting laterally from said leg and being arranged to fit beneath and to engage said undercut of said base section so as to couple said base section and said co-operating section together, said co-operating section adopting a final co-operating section position relative to said base section when said base section and said co-operating section are coupled together and said toe engages beneath said undercut;

said base section and said co-operating section being constructed and arranged so that when said base and said co-operating sections are being coupled together said co-operating section is in a rotated position in which said co-operating section is rotated about said longitudinal direction relative to said final co-operating section position, said co-operating section when being coupled to said base section requiring lateral movement of said toe to a position beneath said undercut and said co-operating section having rotated about a longitudinal axis which extends in said longitudinal direction relative to said base section to adopt said final co-operating section position;

said co-operating and said base sections when assembled together defining at least two linear restraint points where said co-operating and said base sections are in contact and where linear displacement between said base section and said co-operating section is restrained by contact;

said linear restraint points comprising:

a first linear restraint point located at a point of contact of said toe and said undercut where restraint against linear direct separating movement of said base section and said co-operating section away from each other occurs; and a second linear restraint point displaced from said first linear restraint point and where linear translation movement of said base section and said co-operating section at right angles to said longitudinal direction and at right angles to a line of direct separating movement is restrained;

said base section and said co-operating section when assembled and in use further having a rotation restraint point displaced from said linear restraint points and where rotation of said co-operating section relative to said base section in a direction to disengage said toe from said undercut is restrained;

said first and second linear restraint points and said rotation restraint point together defining a triangle of points at which movement of an assembly of said base section and said co-operating section is restrained.

2. A system as claimed in claim 1 wherein said toe is turned up relative to said leg and said undercut is turned down so that, at said first linear restraint point, contact between said toe and said undercut provides at least some restraint against said linear translation movement between said assembly.

3. A system as claimed in claim 1 wherein said co-operating and said base sections are provided with co-operating guide formations which enable said base section and said co-operating section to be initially separate with said leg extending substantially directly towards said base section;

said co-operating guide formations enabling said base section and said co-operating section to be then moved directly linearly towards each other so that said co-operating guide formations guide said base section and said co-operating section into loosely coupled positions in which said toe does not reach and engage beneath said undercut;

said co-operating guide formations being configured so as to require rotation of said co-operating section relative to said base section in a direction opposite to a direction of rotation to effect engagement of said toe with said undercut during close coupling of said base section and said co-operating section together until said toe reaches said undercut and said co-operating section rotates to said final co-operating section position.

4. A system as claimed in claim 3 wherein each of said co-operating guide formations further comprises:

guide means which cause rotation of said co-operating section relative to said base section during relative movement of said base section and said co-operating section from loosely coupled positions into a close coupling position.

5. A system as claimed in claim 1 further comprising:

co-operating guide means for guiding relative movement of said base section and said co-operating section during assembly together so that said toe is guided towards said undercut during assembly of said base section and said co-operating section.

6. A system as claimed in claim 1 wherein said lateral movement of said toe into said position beneath said undercut further comprises:

a pivoting movement of said co-operating section relative to said base section, said pivoting movement occurring about a pivot displaced from a region of said toe and said undercut so that said pivoting movement causes said co-operating section to rotate from said rotated position to adopt said final co-operating section position relative to said base section.

7. A system as claimed in claim 6 further comprising:

guide means for constraining said co-operating section to adopt said rotated position relative to said final co-operating section position during movement of said co-operating section into engagement with said base section and before said toe reaches and engages beneath said undercut.

8. A system as claimed in claim 7 wherein said guide means further comprises:

a wall projecting from said base section towards said co-operating section, said wall having said undercut remote from said co-operating section whereby in assembling said co-operating section to said base section said toe travels down said wall towards said undercut; and a projection located at a top of said wall remote from said undercut, said projection and one of said co-operating guide formations at said top of said wall being capable of engaging with each other upon said co-operating section being oriented in said rotated position;

whereby engagement of said toe against said wall as said toe travels down said wall before reaching said undercut and co-operating engagement of said projection with said one co-operating guide formation maintain said co-operating section in said rotated position until said toe reaches and moves back laterally into a position engaging beneath said undercut.

9. A system as claimed in claim 7 wherein said guide means further comprises:

a wall projecting from said base section towards said co-operating section, said wall being located on an opposite side of said leg to said toe so that said leg is inserted into a space between said wall and said undercut, said guide means further comprising:

a fulcrum defined at a point of contact between said wall and said leg and located so that said co-operating section adopts said rotated position during insertion of said leg between said wall and said undercut and so that rotation of said co-operating section about said fulcrum causes said toe to engage beneath said undercut and causes said co-operating section to adopt said final co-operating section position.

10. A system as claimed in claim 9 wherein said guide means further comprises:

a profiled surface provided by said base section and which is located above said undercut and facing said co-operating section, said profiled surface being engaged by said toe as said base section and said co-operating section are being coupled together and being shaped so as to deflect said toe laterally thereby promoting rotation of said co-operation section to said rotated position until said toe passes said profiled surface and reaches said undercut.

11. A system as claimed in claim 6 wherein either said base section or said co-operating section provides resilient resistance means operative, when said base section and said co-operating section are being coupled together and said co-operating section is in said rotated position before said toe engages beneath said undercut, to resist final stages of linear movement of said co-operating section relatively towards said base section immediately before said toe can move laterally into said position beneath said undercut.

12. A system as claimed in claim 11 wherein said co-operating section further comprises:

a side portion extending laterally therefrom relative to said leg and which engages with a respective structural component, with a resistance means on said side portion which resiliently yields when said co-operating section is being urged into engagement with said base section with said co-operating section in said rotated position thereby enabling said toe to reach said undercut, and said resistance means assisting said co-operating section to rotate to said final co-operating section position and said toe to engage beneath said undercut as a result of resilient return movement of said side portion.

13. A system as claimed in claim 11 wherein said resistance means further comprises:

a resiliently deformable sealing member which engages with one of said respective structural components when said co-operating section and said base section are being urged together with said co-operating section in said rotated position, resilient deformation of said sealing member providing resistance to movement of said co-operating section to a position where said toe can engage beneath said undercut whereby when said toe reaches and moves laterally to engage beneath said undercut, resilient returning movement of said sealing member assists rotation of said co-operating section to said final co-operating section position and assists movement of said toe into position beneath said undercut.

14. A system as claimed in claim 13 wherein said sealing member remains resiliently deformed after said toe has moved into said position beneath said undercut, whereby said resilient deformation of said sealing member biases said co-operating and said base sections in a direction to move them linearly apart thereby biasing said toe into engagement with said undercut.

15. A system as claimed in claim 1 wherein said base section further comprises:

a mouth having said undercut provided at one side thereof and a contoured portion at an opposite side of said mouth;

said leg having on a side thereof opposite to said toe a profiled heel section which co-operates with said contoured portion of said mouth during rotation of said co-operating section to maintain said toe in a position beneath the undercut;

contact between said profiled heel section and said contoured portion of said mouth constituting said second linear restraint point after said co-operating section has been rotated to said final co-operating section position.

16. A system as claimed in claim 15 wherein said base section further comprises:

a spacious access zone enabling said leg with said toe projecting therefrom to be located in said access zone with a loose tolerance and at a range of angular positions all of which are angularly displaced from said final position of said co-operating section, said access zone being shaped to guide said toe towards and into engagement with said undercut during rotation of said co-operating section towards said final co-operating section position.

17. A structural mounting system for mounting of structural components together, said system comprising:

a base section and a co-operating section each of which in use is secured to a respective structural component and which are assembled together for mounting of said structural components together;

said base section being elongated in a longitudinal direction, said base section when viewed in cross-section transverse to said longitudinal direction comprising an undercut;

said co-operating section being elongated in said longitudinal direction, said co-operating section, when viewed in cross-section transverse to said longitudinal direction, further comprising a leg projecting generally perpendicular to said longitudinal direction, said leg having a toe projecting laterally from said leg and being arranged to fit beneath and to engage said undercut of said base section so as to couple said base section and said co-operating section together, said co-operating section adopting a final co-operating section position relative to said base section when said base section and said co-operating section are coupled together and said toe engages beneath said undercut;

said base section and said co-operating section being constructed and arranged so that when said base and said co-operating sections are being coupled together said co-operating section is in a rotated position in which said co-operating section is rotated about said longitudinal direction relative to said final co-operating section position, said co-operating section when being coupled to said base section requiring lateral movement of said toe to a position beneath said undercut and said co-operating section having rotated about a longitudinal axis which extends in said longitudinal direction relative to said base section to adopt said final co-operating section position;

said co-operating and said base sections when assembled together defining at least two linear restraint points where said co-operating and said base sections are in contact and where linear displacement between said base section and said co-operating section is restrained by contact;

said linear restraint points comprising:

a first linear restraint point located at a point of contact of said toe and said undercut where restraint against linear direct separating movement of said base section and said co-operating section away from each other occurs; and a second linear restraint point displaced from said first linear restraint point and where linear translation movement of said base section and said co-operating section at right angles to said longitudinal direction and at right angles to a line of direct separating movement is restrained;

said base section and said co-operating section when assembled and in use further having a rotation restraint point displaced from said linear restraint points and where rotation of said co-operating section relative to said base section in a direction to disengage said toe from said undercut is restrained;

said first and second linear restraint points and said rotation restraint point together defining a triangle of points at which movement of an assembly of said base section and said cooperating section is restrained, said toe turned up relative to said leg and said undercut turned down so that, at said first linear restraint point, contact between said toe and said undercut provides at least some restraint against said linear translation movement between said assembly.

18. A structural mounting system for mounting of structural components together, said system comprising:

a base section and a co-operating section each of which in use is secured to a respective structural component and which are assembled together for mounting of said structural components together;

said base section being elongated in a longitudinal direction, said base section when viewed in cross-section transverse to said longitudinal direction comprising an undercut;

said co-operating section being elongated in said longitudinal direction, said co-operating section, when viewed in cross-section transverse to said longitudinal direction, further comprising a leg projecting generally perpendicular to said longitudinal direction, said leg having a toe projecting laterally from said leg and being arranged to fit beneath and to engage said undercut of said base section so as to couple said base section and said co-operating section together, said co-operating section adopting a final co-operating section position relative to said base section when said base section and said co-operating section are coupled together and said toe engages beneath said undercut;

said base section and said co-operating section being constructed and arranged so that when said base and said co-operating sections are being coupled together said co-operating section is in a rotated position in which said co-operating section is rotated about said longitudinal direction relative to said final co-operating section position, said co-operating section when being coupled to said base section requiring lateral movement of said toe to a position beneath said undercut and said co-operating section having rotated about a longitudinal axis which extends in said longitudinal direction relative to said base section to adopt said final co-operating section position;

said co-operating and said base sections when assembled together defining at least two linear restraint points where said co-operating and said base sections are in contact and where linear displacement between said base section and said co-operating section is restrained by contact;

said linear restraint points comprising:

a first linear restraint point located at a point of contact of said toe and said undercut where restraint against linear direct separating movement of said base section and said co-operating section away from each other occurs; and a second linear restraint point displaced from said first linear restraint point and where linear translation movement of said base section and said co-operating section at right angles to said longitudinal direction and at right angles to a line of direct separating movement is restrained;

said base section and said co-operating section when assembled and in use further having a rotation restraint point displaced from said linear restraint points and where rotation of said co-operating section relative to said base section in a direction to disengage said toe from said undercut is restrained;

said first and second linear restraint points and said rotation restraint point together defining a triangle of points at which movement of an assembly of said base section and said co-operating section is restrained, said lateral movement of said toe into said position beneath said undercut further comprises:

a pivoting movement of said co-operating section relative to said base section, said pivoting movement occurring about a pivot displaced from a region of said toe and said undercut so that said pivoting movement causes said co-operating section to rotate from said rotated position to adopt said final co-operating section position relative to said base section;

either said base section or said co-operating section provides resilient resistance means operative, when said base section and said co-operating section are being coupled together and said co-operation section is in said rotated position before said toe engages beneath said undercut, to resist final stages of linear movement of said co-operating section relatively towards said base section immediately before said toe can move laterally into said position beneath said undercut;

said resistance means further comprises:

a resiliently deformable sealing member which engages with one of said respective structural components when said co-operating section and said base section are being urged together with said co-operating section in said rotated position, resilient deformation of said sealing member providing resistance to movement of said co-operating section to a position where said toe can engage beneath said undercut whereby when said toe reaches and moves laterally to engage beneath said undercut, resilient returning movement of said sealing member assists rotation of said co-operating section to said final co-operating section position and assists movement of said toe into position beneath said undercut.

19. A system as claimed in claim 18 wherein said sealing member remains resiliently deformed after said toe has moved into said position beneath said undercut, whereby said resilient deformation of said sealing member biases said co-operating and said base sections in a direction to move them linearly apart thereby biasing said toe into engagement with said undercut.

* * * * *